US008419457B2

(12) United States Patent
Lee et al.

(10) Patent No.: US 8,419,457 B2
(45) Date of Patent: Apr. 16, 2013

(54) ANTI-ELECTROMAGNETIC INTERFERENCE ELECTRICAL CONNECTOR AND TERMINAL ASSEMBLY THEREOF

(75) Inventors: Kuo-Chi Lee, New Taipei (TW); Chin-Huang Lin, New Taipei (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 13/218,721

(22) Filed: Aug. 26, 2011

(65) Prior Publication Data

US 2013/0052865 A1 Feb. 28, 2013

(51) Int. Cl.
*H01R 13/62* (2006.01)

(52) U.S. Cl.
USPC ..... 439/326

(58) Field of Classification Search ..... 439/326–328
See application file for complete search history.

(56) References Cited

U.S. PATENT DOCUMENTS 5,259,768 A * 11/1993 Brunker et al. ..... 439/60
5,522,737 A * 6/1996 Brunker et al. ..... 439/637
5,580,257 A * 12/1996 Harwath ..... 439/108
5,730,609 A * 3/1998 Harwath ..... 439/108
5,813,883 A * 9/1998 Lin ..... 439/637
6,015,299 A * 1/2000 Walse et al. ..... 439/60
6,019,639 A * 2/2000 Brunker et al. ..... 439/637
6,095,821 A * 8/2000 Panella et al. ..... 439/60
6,254,435 B1 * 7/2001 Cheong et al. ..... 439/637
6,358,061 B1 * 3/2002 Regnier ..... 439/60
6,361,367 B1 * 3/2002 Daikuhara et al. ..... 439/607.07
6,394,823 B1 * 5/2002 Dunham et al. ..... 439/108
6,561,850 B2 * 5/2003 Letourneau et al. ..... 439/607.08
6,805,586 B2 * 10/2004 Akama et al. ..... 439/607.07
RE38,736 E * 5/2005 Walse et al. ..... 439/60
6,923,664 B2 * 8/2005 Ito et al. ..... 439/108
6,994,563 B2 * 2/2006 Amini et al. ..... 439/62
7,048,567 B2 * 5/2006 Regnier et al. ..... 439/329
7,410,392 B2 * 8/2008 Szczesny et al. ..... 439/607.05
7,591,684 B2 * 9/2009 Zhang et al. ..... 439/660
7,604,510 B2 * 10/2009 Akama et al. ..... 439/637
7,806,730 B2 * 10/2010 Szczesny et al. ..... 439/637
7,824,224 B2 * 11/2010 Su et al. ..... 439/629
8,036,284 B2 * 10/2011 Horowitz et al. ..... 375/257
8,047,875 B2 * 11/2011 Yamakami et al. ..... 439/660
8,152,539 B2 * 4/2012 Moriyama et al. ..... 439/108
8,231,411 B1 * 7/2012 Westman et al. ..... 439/607.05
2003/0003804 A1 * 1/2003 Letourneau et al. ..... 439/608
2003/0060083 A1 * 3/2003 Akama et al. ..... 439/608
2004/0018759 A1 * 1/2004 Wu ..... 439/108
2004/0242071 A1 * 12/2004 Ito et al. ..... 439/608
2007/0184718 A1 * 8/2007 Akama et al. ..... 439/608
2010/0190385 A1 * 7/2010 Yamakami et al. ..... 439/700
2012/0225588 A1 * 9/2012 Westman et al. ..... 439/636

* cited by examiner

*Primary Examiner* — Ross Gushi
(74) *Attorney, Agent, or Firm* — Rabin & Berdo, P.C.

(57) ABSTRACT

An anti-electromagnetic interference (anti-EMI) electrical connector having a terminal assembly is provided. The anti-EMI electrical connector includes an electrical insulation case, a plurality of first terminals, and a plurality of second terminals. The electrical insulation case includes a slot. Each of the first terminals is respectively disposed in the electrical insulation case, and each of the first terminals respectively includes a contact end located in the slot. Each of the second terminals is respectively disposed in the electrical insulation case, and the second terminals and the first terminals are arranged in a staggered manner. Each of the second terminals respectively includes a connection end located in the slot and adjacent to the contact end of at least one first terminal, in which a sectional area of the connection end of the second terminal is larger than a sectional area of the contact end of the first terminal.

6 Claims, 9 Drawing Sheets

ANTI-ELECTROMAGNETIC INTERFERENCE ELECTRICAL CONNECTOR AND TERMINAL ASSEMBLY THEREOF

BACKGROUND OF THE DISCLOSURE

1. Technical Field

This disclosure relates to an electrical connector, and more particularly to an anti-electromagnet interference (EMI) electrical connector and a terminal assembly thereof.

2. Related Art

A signal terminal performs signal transmission through high-frequency current switching. Therefore, when a high-frequency current passes through the signal terminal and is switched rapidly, a magnetic field is generated around the signal terminal.

In an electrical connector in the prior art, a pitch between the terminals is quite small, since the number of small-sized signal terminals is high. When the signal terminal generates the magnetic field, an EMI phenomenon is likely to occur between the adjacent signal terminals, causing a transmission error, and affecting a transmission efficiency of the signal terminals.

In order to solve the EMI phenomenon between the adjacent terminals, taking a Double Data Rate (DDR) connector as an example, a terminal arrangement manner thereof is to arrange the signal terminals and ground pins in a staggered manner with intervals, so as to shield the EMI between the adjacent signal terminals through the ground pins. However, the above ground pin can only shield the EMI to a limited degree; if the arrangement of the terminals is more intensive, a shielding effect of the ground pin is very limited.

SUMMARY

Accordingly, this disclosure provides an anti-electromagnet interference (EMI) electrical connector and a terminal assembly thereof, so as to eliminate EMI between terminals.

At least one embodiment of this disclosure provides an anti-electromagnet interference (EMI) electrical connector. The anti-EMI electrical connector includes an electrical insulation case, a plurality of first terminals, and a plurality of second terminals.

The electrical insulation case includes a slot. Each of the first terminals is respectively disposed in the electrical insulation case, and each of the first terminals respectively includes a contact end located in the slot. Each of the second terminals is respectively disposed in the electrical insulation case, and the second terminals and the first terminals are arranged in a staggered manner.

Each of the second terminals respectively includes a connection end located in the slot and adjacent to the contact end of at least one first terminal, in which a sectional area of the connection end of the second terminal is larger than a sectional area of the contact end of the first terminal.

The sectional area of the connection end is larger than the sectional area of the contact end. Therefore, when a high-frequency signal is transmitted between the first terminals, the resulting the resulting EMI is effectively blocked by the connection end of the second terminal, thereby eliminating the EMI between the first terminals.

At least one embodiment of this disclosure further provides a terminal assembly. The terminal assembly is provided to be combined with an electrical insulation case, so as to form an anti-EMI electrical connector. The terminal assembly includes a fixing seat, a plurality of first terminals, and a plurality of second terminals.

The first terminals are fixed on the fixing seat, and each of the first terminals respectively includes a contact end. The second terminals are fixed on the fixing seat, in which the second terminals and the first terminals are arranged in a staggered manner. Each of the second terminals respectively includes a connection end adjacent to the contact end of at least one first terminal, and a sectional area of the connection end is larger than a sectional area of the contact end.

In the terminal assembly described previously, the sectional area of the connection end is larger than the sectional area of the contact end. Therefore, when a high-frequency signal is transmitted by the first terminals, the resulting EMI is effectively shielded by the connection end of the second terminals, thereby eliminating the EMI between the first terminals.

In the this disclosure, the sectional area of the connection end is larger than the sectional area of the contact end, that is, the sectional area of the second terminal is increased to increase an effective shielding area and improve electrical characteristics. When the first terminal performs data transmission, shielding of the second terminal can be used to block the EMI, therefore achieving an objective of maintaining electronic signal quality.

Preferred embodiments and efficacies thereof of this disclosure are hereinafter described with reference to the accompanying drawings.

BRIEF DESCRIPTION OF THE DRAWINGS

The disclosure will become more fully understood from the detailed description given herein below for illustration only and thus not limitative of this disclosure, wherein.

DETAILED DESCRIPTION

Figure 1:
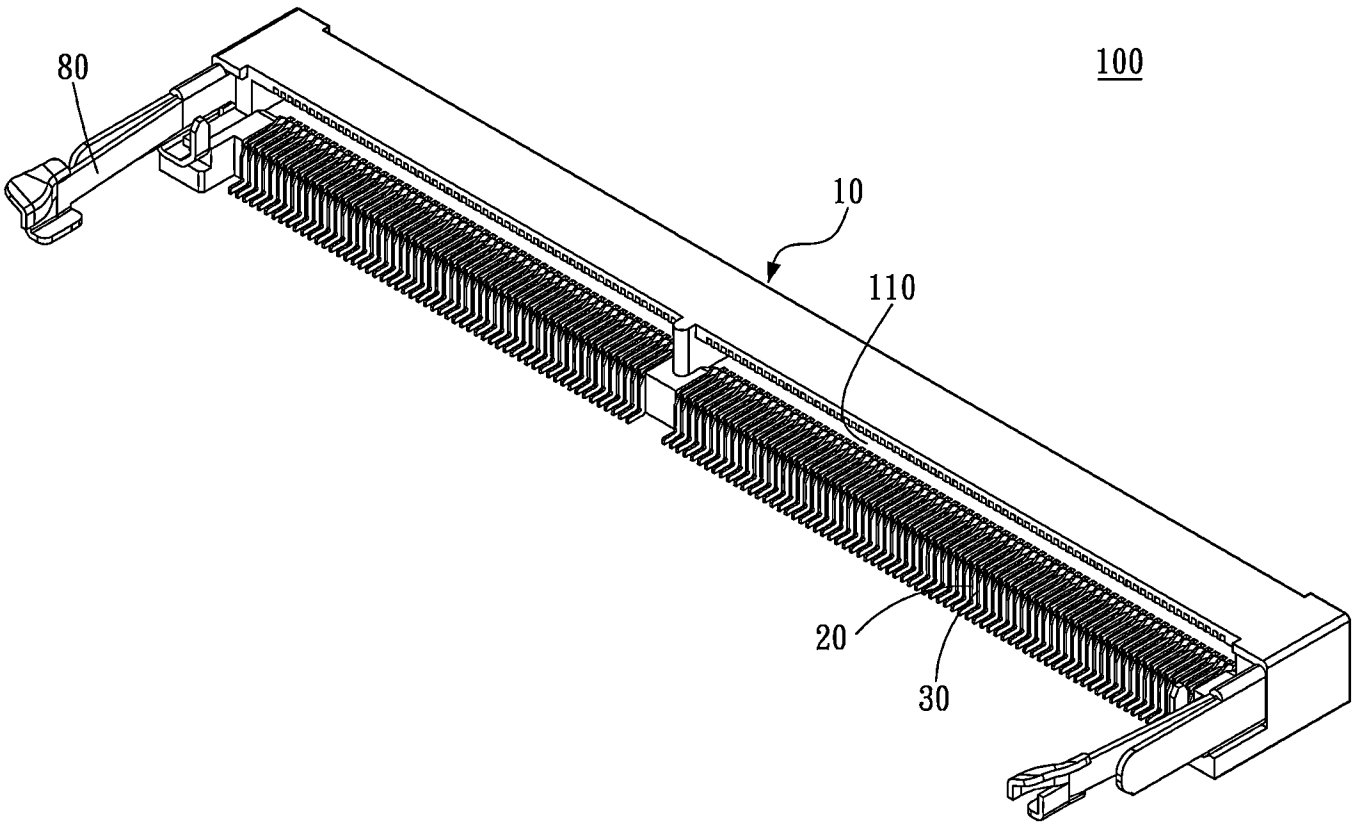
FIG. 1 is a perspective view of a first embodiment.
Figure 2:
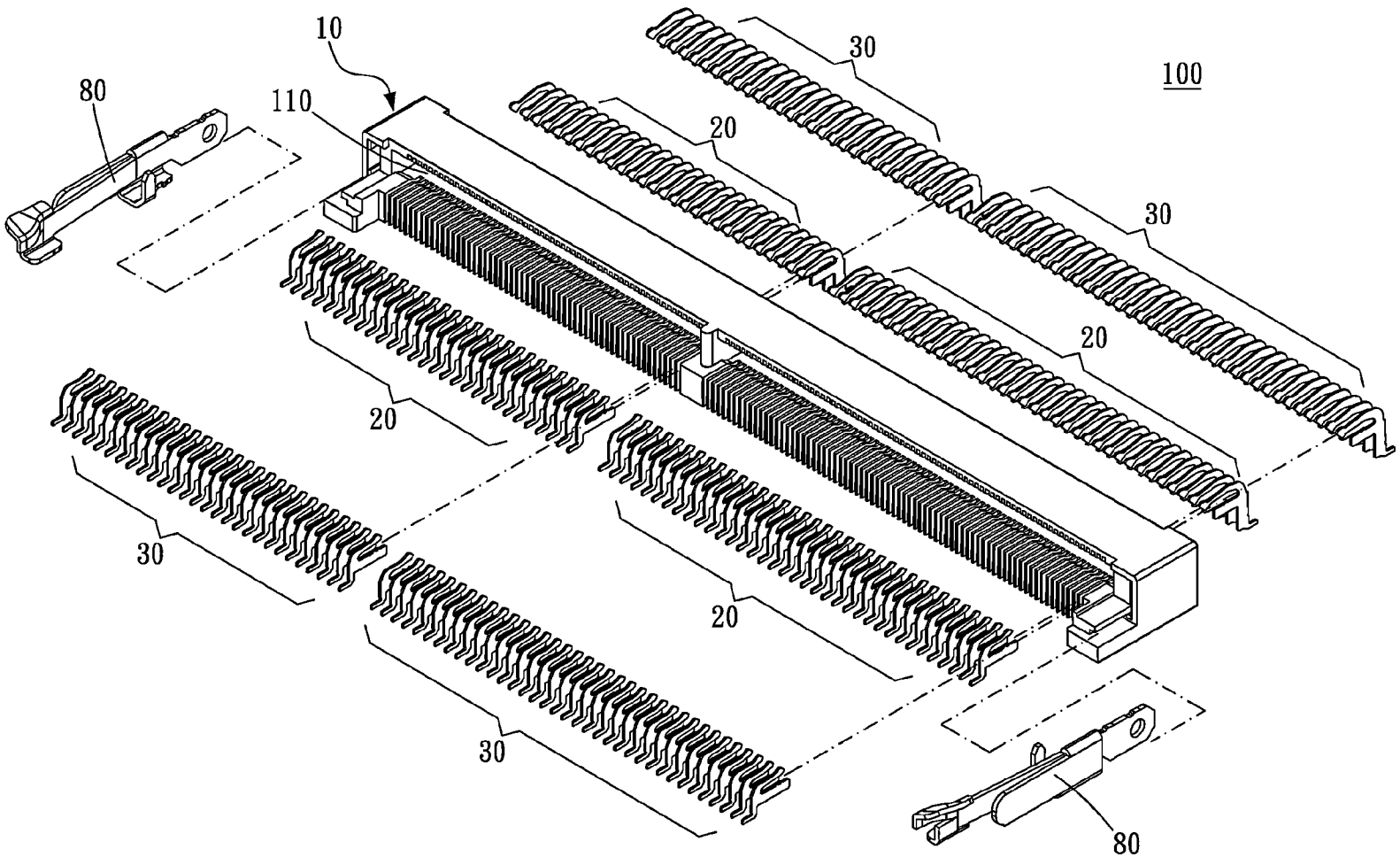
FIG. 2 is an exploded view of a first embodiment.

Please refer to FIG. 1 and FIG. 2, an anti-EMI electrical connector according to a first embodiment is provided to be electrically connected to an electrical plug (not shown). The anti-EMI electrical connector includes an electrical insulation case 10, a plurality of first terminals 20, and a plurality of second terminals 30.

Please refer to FIG. 1 and FIG. 2, the electrical insulation case 10 includes a slot 110. The above-mentioned the electrical plug is provided to be inserted into the slot 110 correspondingly. Take a DDR memory module socket as an example of the electrical connector, the slot 110 is in a slim shape, and the electrical plug has a flat shape matching the slot 110, and is located at an edge of the DDR memory module.

Figure 3:
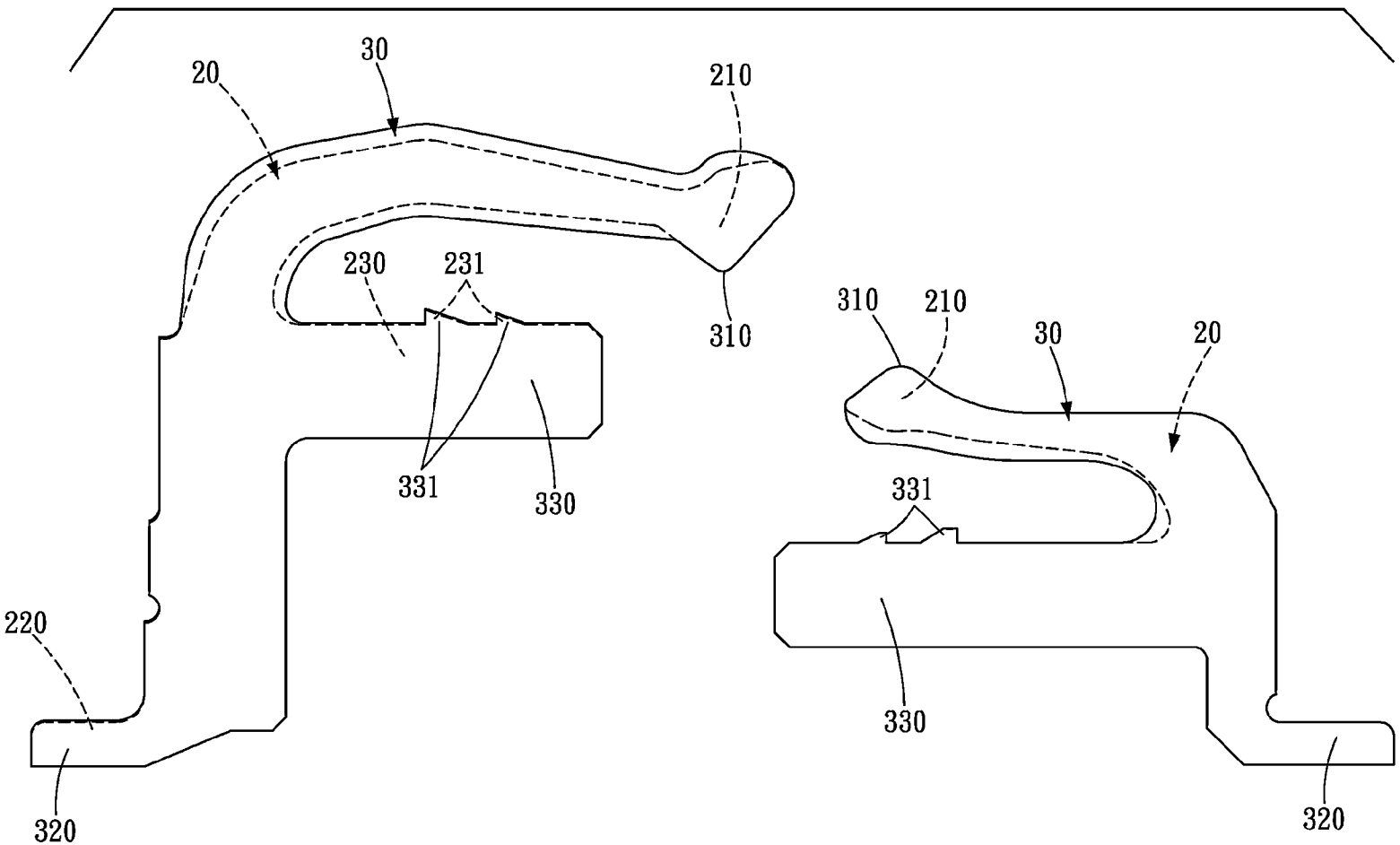
FIG. 3 is a perspective view of a terminal according to a first embodiment.

Please refer to FIG. 1, FIG. 2, and FIG. 3, the first terminals 20 are disposed in the electrical insulation case 10, and each of the first terminals 20 respectively includes a contact end 210. The contact ends 210 are located in the slot 110 of the electrical insulation case 10. The first terminals 20 are used for signal transmission, and in detail, each of the first terminals is a signal transmission terminal.

The first terminal 20 further includes a first welding end 220 and a first locating end 230. The first welding end 220 is provided to be welded on a circuit board, such as a computer motherboard, so that the electrical connector is fixed on the circuit board through the first welding end 220 of the first terminal 20, and further electrically connects the circuit board. The first locating end 230 is provided to be combined with the electrical insulation case 10, in which the first locating end 230 further includes a barb 231 for snapping the electrical insulation case 10, therefore the first terminal is combined with the electrical insulation case 10 in a clamping manner.

Please refer to FIG. 1, FIG. 2, and FIG. 3, the second terminals 30 are disposed in the electrical insulation case 10. The second terminals 30 and the first terminals 20 are arranged in a staggered manner, that is, one first terminal 20 is followed by one second terminal 30.

Each of the second terminals 30 includes a connection end 310 located in the slot 110 and adjacent to at least one of the contact ends 210 of the first terminals 20. For example, the connection end 310 at an outermost side is located at a side edge of one contact end 210, but the connection end 310 and the contact end 210 do not contact each other; and the rest of the connection ends 310 are located between the two contact ends 210. The number of the connection ends 310 and the contact ends 210 may be set correspondingly, or the number of the connection ends 310 may be larger than, equal to, or smaller than the number of the contact ends 210.

As shown in FIG. 3, a sectional area of the connection end 310 of the second terminal 30 is larger than a sectional area of the contact end 210 of the first terminal 20. Observing from a lateral side, the sectional area of the contact end 210 of the second terminal 30 is increased to increase an effective shielding area of the contact end 210 and improve electrical characteristics. Therefore, when the first terminal 20 performs data transmission, shielding of the second terminal 30 can be used to restrain EMI of each of the first terminals 20, so as to maintain quality of an electronic signal.

In an implementation manner of the embodiment, the second terminals 30 are electrically grounded to serve as ground pins. It is noted that, in order to increase the sectional area of the second terminal 30, an original insert molding structure is modified to an insert terminal structure. Each of the second terminals 30 further includes a second welding end 320 and a second locating end 330. The second welding end 320 is provided to be welded on a circuit board, such as a computer motherboard, so that the electrical connector is fixed on the circuit board through the second welding end 320 of the second terminal 20, and further electrically connects a grounding circuit of the circuit board. The second locating end 330 is provided to be combined with the electrical insulation case 10. The second locating end 330 further includes a barb 331 for snapping the electrical insulation case 10.

As shown in FIG. 1 and FIG. 2, the electrical connector 100 further includes a positioning member 80 disposed in the electrical insulation case 10 for positioning and latching the electrical plug. When the electrical plug 90 is inserted in the slot 110 to be electrically connected to the contact end 210 and the connection end 310, the positioning member 80 is snapped on the electrical plug 90.

Figure 4:
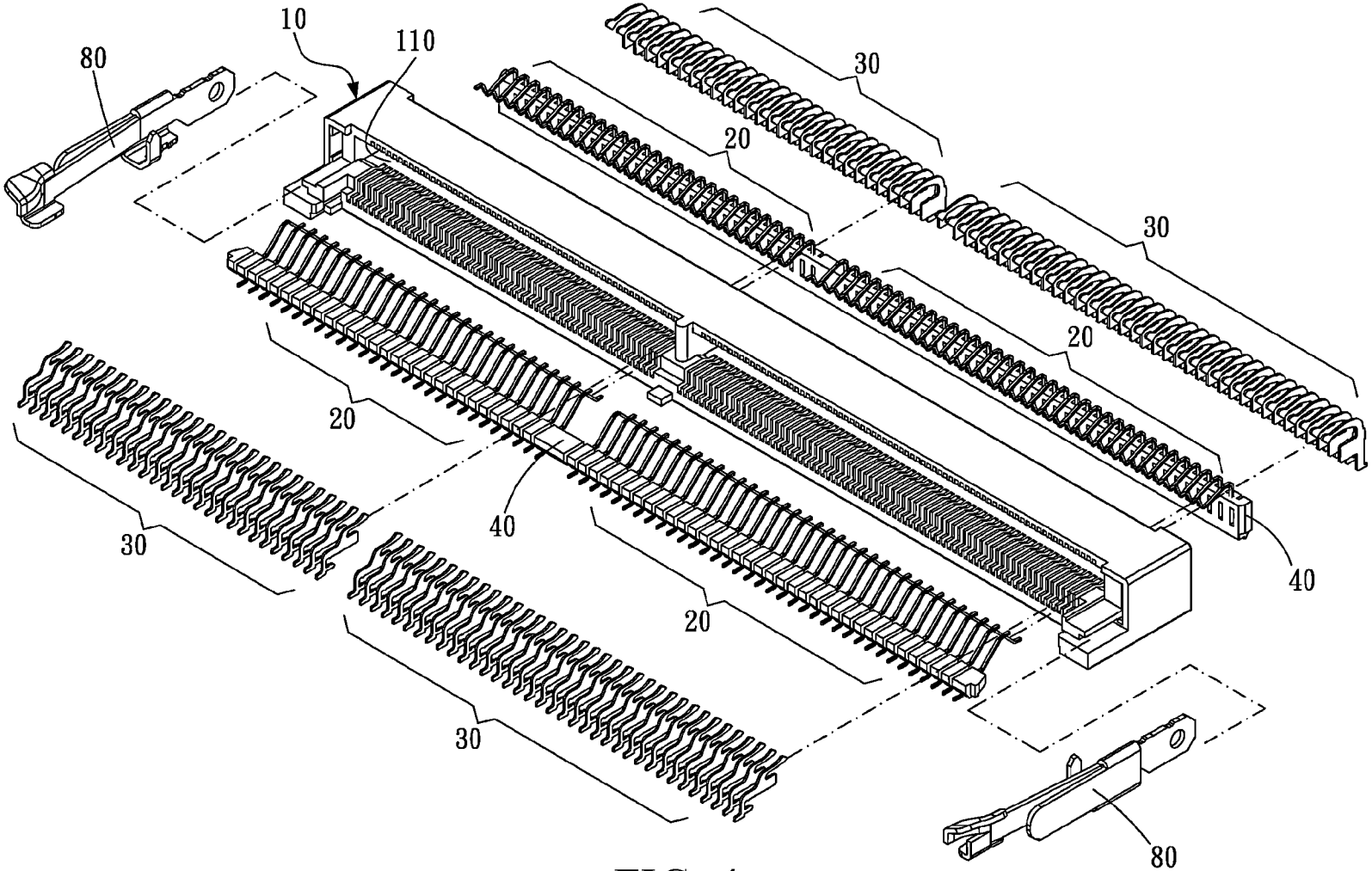
FIG. 4 is an exploded view of a second embodiment.

Please refer to FIG. 4, a terminal assembly 200 according a second embodiment is provided to be combined with the electrical insulation case 10, so as to form an anti-EMI electrical connector. The terminal assembly 200 includes a fixing seat 40, a plurality of first terminals 20, and a plurality of second terminals 30.

Figure 5:
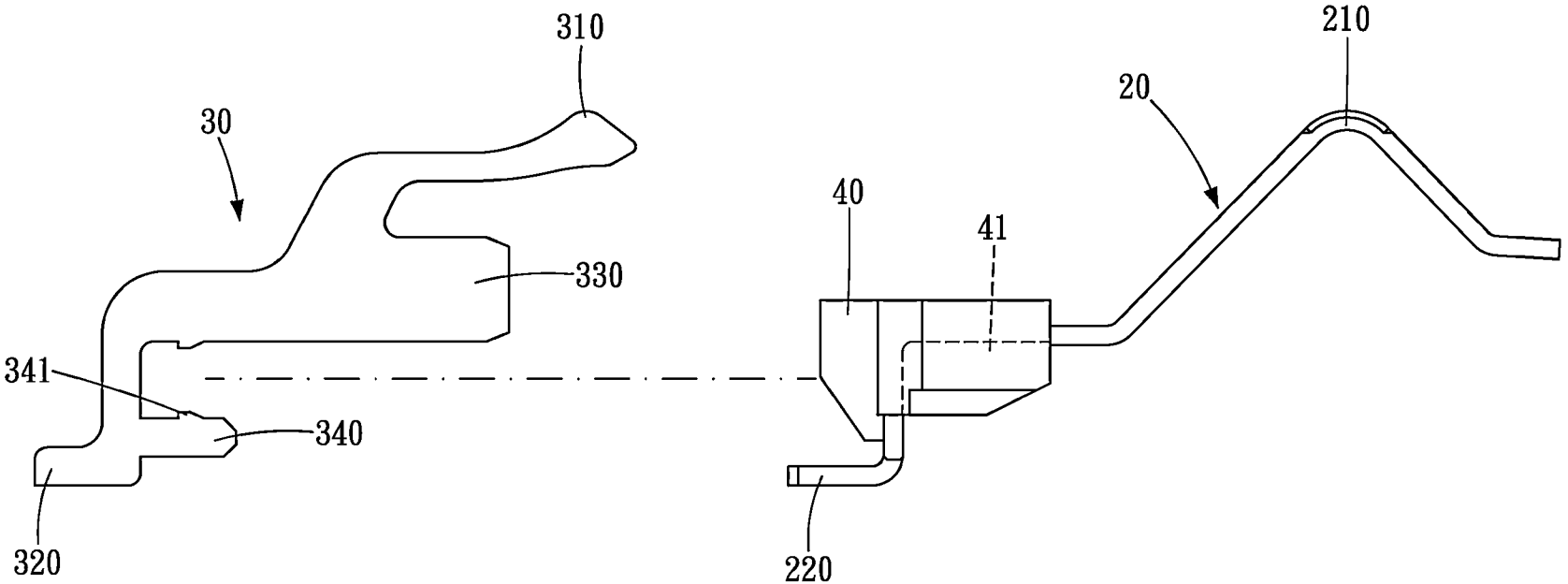
FIG. 5 is a side view of a terminal assembly according to a second embodiment.
Figure 6:
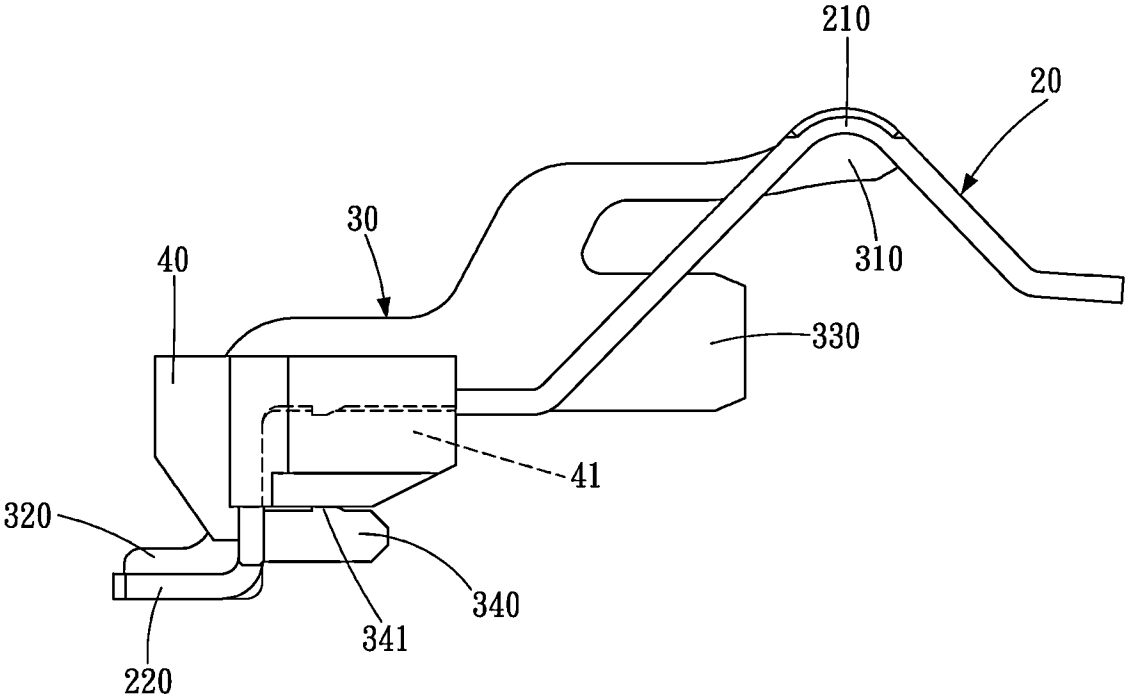
FIG. 6 is another side view of a terminal assembly according to a second embodiment.
Figure 7:
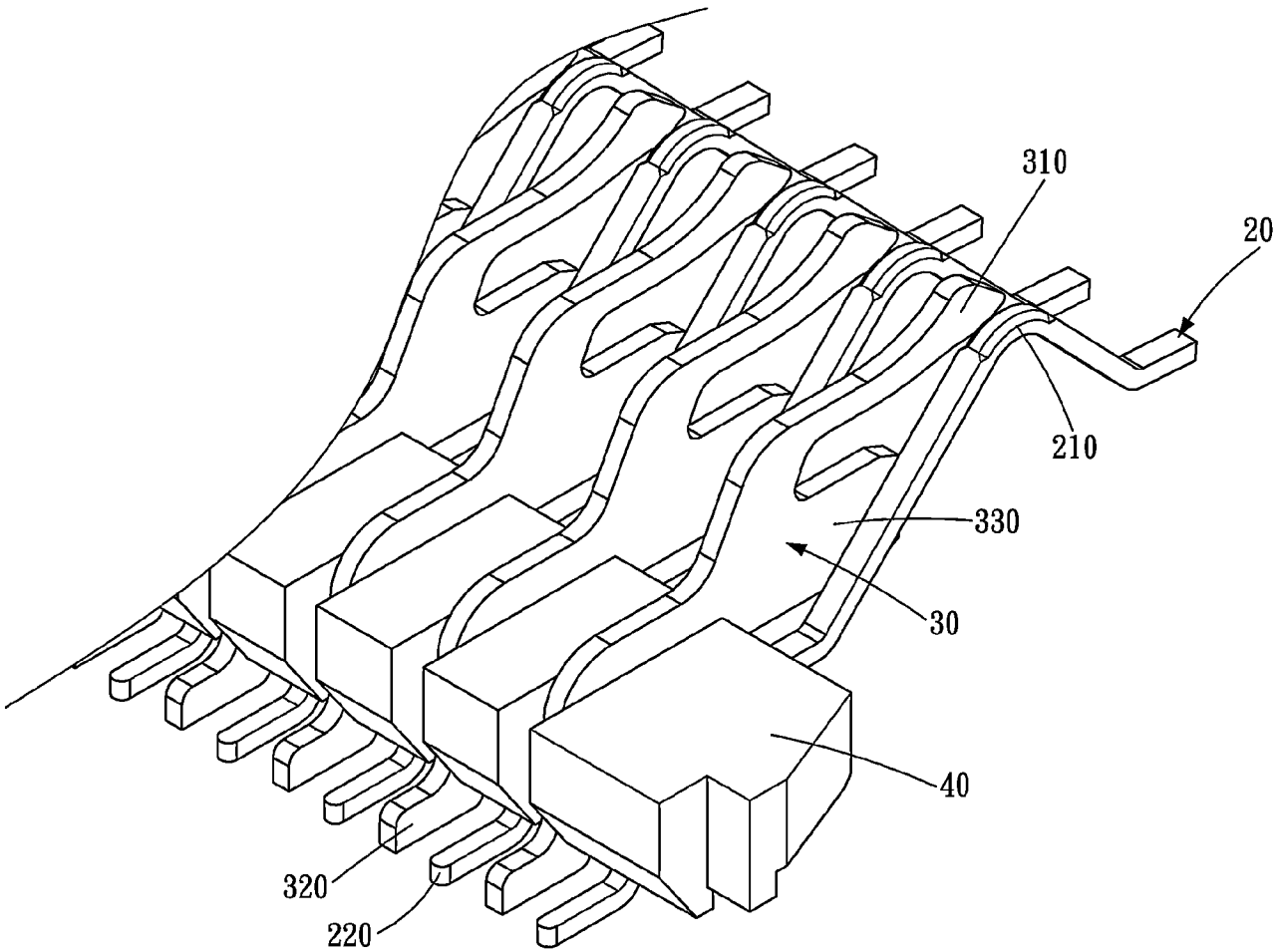
FIG. 7 is an enlarged perspective view of a terminal assembly according to a second embodiment.
Figure 8:
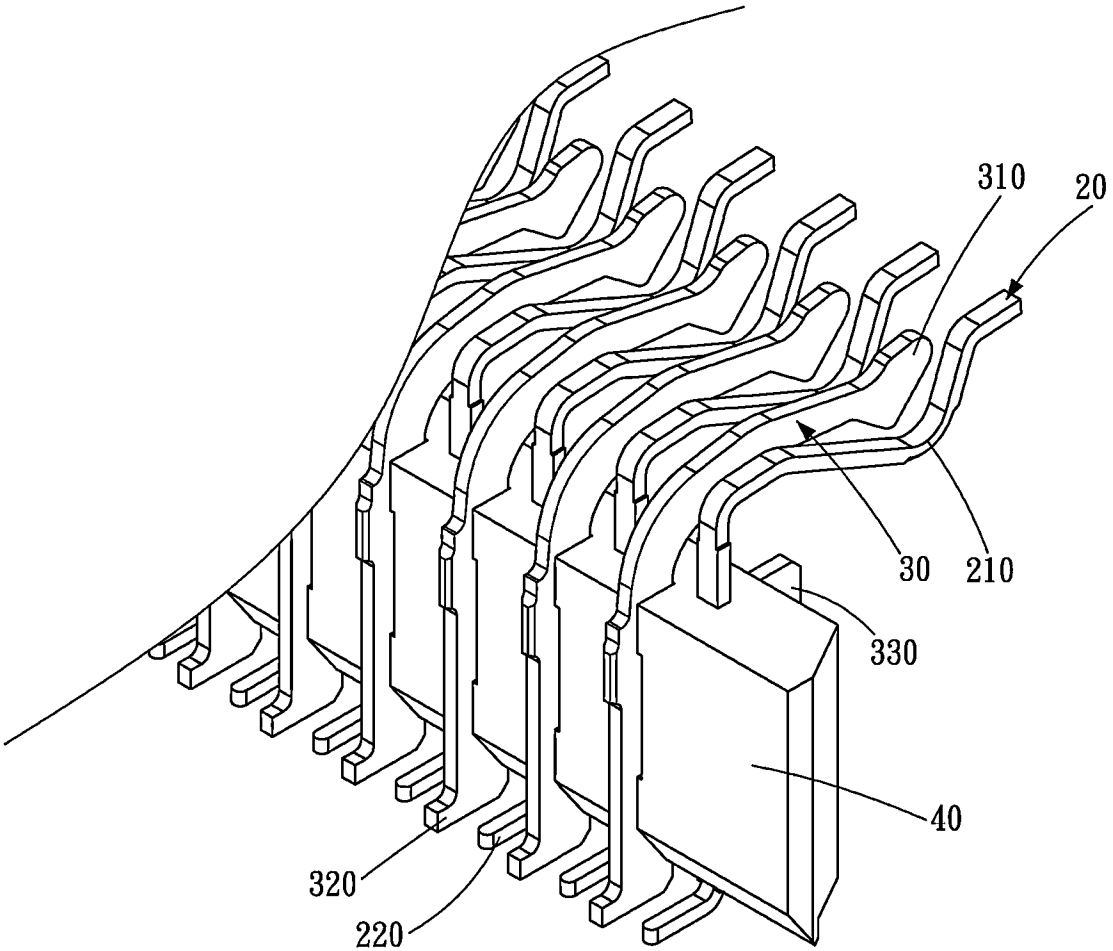
FIG. 8 is another enlarged perspective view of a terminal assembly according to a second embodiment.

As shown in FIG. 4 and FIG. 5, the first terminals 20 are fixed on the fixing seat 40, and each of the first terminals 20 respectively includes a contact end 210.

The second terminals 30 are fixed on the fixing seat 40. The second terminals 30 and the first terminals 20 are arranged in a staggered manner. Each of the second terminals 30 respectively includes a connection end 310 adjacent to at least one contact end 210, and a sectional area of the connection end 310 is larger than a sectional area of the contact end 210.

Please refer to FIG. 5 to FIG. 8, fixing slots 41 is formed on the fixing seat 40, and each of the second terminals 30 respectively includes a second locating end 330 and a third locating end 340. At least one of the second locating end 330 and the third locating end 340 is embedded into the fixing slot 41, so that second locating end 330 and the third locating end 340 clamps the fixing seat 40, thereby combining the second terminal 30 with the fixing seat 40. In addition, the third locating end 340 further includes a barb 341 for snapping the fixing seat 40; therefore the second terminal 30 is combined with the fixing seat 40 in an inserting manner.

This description of the second terminal 30 combined with the fixing seat 40 is merely an example, and substitute methods may be used to combine the second terminals 30 with the fixing seat 40 through inserting, or combine the first terminals 20 or the second terminals 30 with the fixing seat 40 in an insert molding manner.

Figure 9:
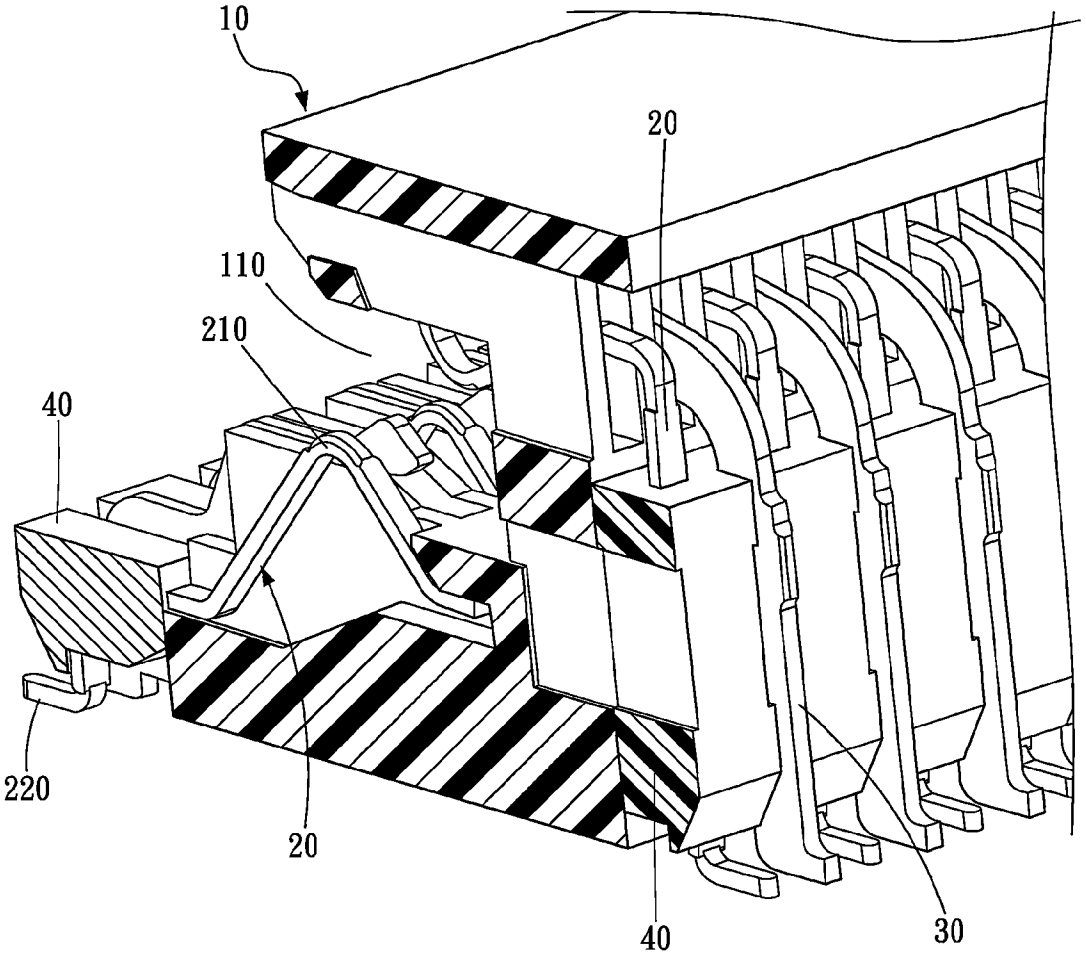
FIG. 9 is another enlarged perspective view of a second embodiment.

As shown in FIG. 9, in the second embodiment the sectional area of the contact end 210 of the second terminal 30 is increased to increase an effective shielding area of the contact end 210 and improve electrical characteristics. Therefore, when the first terminal 20 performs data transmission, shielding of the second terminal 30 can be used to block EMI of each of the first terminals 20, so as to maintain quality of an electronic signal. Therefore, in the second embodiment, after the terminal assembly 200 is combined with the electrical insulation case 10, the first terminal 20 and the second terminal 30 are corresponding to the slot 110, which forms an anti-EMI electrical connector.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A terminal assembly, comprising:

a fixing seat;

a plurality of first terminals, fixed on the fixing seat, and each of the first terminals respectively comprising a contact end; and a plurality of second terminals, fixed on the fixing seat; wherein the fixing seat combines the first terminals or the second terminals in an insert molding manner, the second terminals and the first terminals are arranged in a staggered manner, each of the second terminals respectively comprises a connection end adjacent to at least one of the contact ends, and a sectional area of the connection end is larger than a sectional area of the contact end.

2. The terminal assembly as claimed in claim 1, wherein the second terminals are combined with the fixing seat in an inserting manner.

3. The terminal assembly as claimed in claim 1, wherein each of the second terminals respectively comprises a second locating end and a third locating end for clamping the fixing seat to combine the second terminal with the fixing seat.

4. The terminal assembly as claimed in claim 3, wherein the third locating end further comprises a barb for snapping on the fixing seat.

5. The terminal assembly as claimed in claim 1, wherein the first terminal further comprises a first welding end to be welded on a circuit board.

6. The terminal assembly as claimed in claim 1, wherein the second terminal further comprises a second welding end to be welded on a circuit board.

* * * * *